United States Patent [19]

Bird

[11] 4,434,604

[45] Mar. 6, 1984

[54] STRAP

[76] Inventor: Elizabeth A. Bird, Mill House, Mill La., Wychbold, Droitwich, West Midlands, England

[21] Appl. No.: 359,383

[22] Filed: Mar. 18, 1982

[30] Foreign Application Priority Data

Mar. 19, 1981 [GB] United Kingdom ..... 8108618

[51] Int. Cl.[3] ..... B68C 1/00; B68C 1/14

[52] U.S. Cl. ..... 54/23

[58] Field of Search ..... 54/28, 23, 34, 46, 58, 54/65, 66, 79; 2/311, 321, 322, 338, 339

[56] References Cited

U.S. PATENT DOCUMENTS

| | | | |
|---|---|---|---|
| 841,157 | 1/1907 | Knothe | 2/338 |
| 2,066,855 | 1/1937 | Robertson | 54/23 |
| 2,220,593 | 11/1940 | Watson | 2/339 |
| 3,828,521 | 8/1974 | Dulaney | 54/23 |
| 4,132,055 | 1/1979 | Bird | 54/23 |

*Primary Examiner*—Gene Mancene

*Assistant Examiner*—Kris R. Schulze

[57] ABSTRACT

A cinch strap is provided which is generally of two-part construction. The first part comprises a tensile load-carrying band and buckles are secured to opposite ends thereof so that the strap can be fastened to a saddle. The second part comprises a resiliently compressible, cushioning band secured in face to face relationship with the first part. A closed loop is formed at the center of the strap by respective lengths of the bands and the respective length of the first band lies in a slack bight in an unstressed condition. When the strap is subjected to increasing longitudinal tensile load, for example, by the body of a horse the respective length of the second band stretches until the slack is taken up and any further increase in load is shared between both lengths.

8 Claims, 5 Drawing Figures

STRAP

FIELD OF INVENTION

The present invention relates to a strap, for example in the equestrian equipment field a saddlery body strap such as a girth or cinch, for securing a saddle in position, which in use lies against the body of the horse and which is subjected to a tensile load.

BACKGROUND OF INVENTION

In their traditional construction such saddlery body straps have been made of leather, but other materials have also been used and, in particular, the use of carefully selected materials based on various synthetic plastics has found some favour in recent times. Also, it is known o incorporate padding or cushioning materials in the construction of such body straps in order to improve comfort and reduce the risk of chafing and injury to the body of the horse.

In producing such body straps, however, it is also frequently necessary to ensure that their overall resilient stretching characteristics or elasticity under tensile load falls within closely defined limits. This can be a general requirement, but control of this overall elasticity combined with a high breaking strength can be especially important when the strap is likely to be subjected to high and variable tensile loading, as for instance in the case of a cinch used for securing a "Western type" saddle on a horse which may take part in very energetic activities like rodeo riding.

By way of example, in my prior U.S. Pat. No. 4,132,055 there is disclosed a body strap of equestrian harness or saddlery equipment made up basically of a tubular webbing sheath which is formed of woven yarn composed of staple fibres of synthetic polymer material and which is filled with an insert of foam expanded plastics materials to provide cushioning characteristics, end straps carrying strap fastening fittings such as buckles being secured to the ends of the sheath, and the overall elasticity is controlled by securing to the sheath discontinuous reinforcing band or strip portions having an elasticity or resilient stretch less than that of the sheath material. With the construction described, however, the ultimate breaking strength is limited to that of the webbing sheath and in general this form of construction has been found to be capable of improvement for at least some special purpose body straps.

SUMMARY OF THE INVENTION

According to the present invention a strap, for example a cinch strap, comprises a first strap portion in the form of at least one tensile load-carrying band or strip, fastening fittings such as buckles connected at opposite ends of said strap, and, overlying in use said first strap portion preferably in face to face relationship therewith, a second strap portion which is in the form of a band or strip having relatively soft resiliently compressible cushioning characteristics, said strap including at least one loop region formed by a loop section of preselected length of the first strap portion being secured at its opposite ends to the opposite ends of a loop section of the second strap portion which has a preselected length less than that of said first strap portion loop section such that the latter lies in a slack bight spanned by said second strap portion loop section, whereby in use under an increasing tensile load initially said load is carried in the loop region, or in each such loop region, by the second strap portion loop section which stretches and extends longitudinally until the slack of the bight of the first strap portion loop section is taken up whereupon any further increase in the tensile load is then shared in said loop region or regions between the first and second strap portion loop sections so providing an abrupt increase in resistance to stretching. Preferably, each loop region provides, during initial longitudinal stretching of the strap, a longitudinal region of the strap having an elasticity equal to if not greater than any other longitudinal region of the strap.

In preferred embodiments the second strap portion has a greater elasticity, that is, it has a smaller modulus of elasticity and will resiliently stretch further under a tensile load in a longitudinal direction, than the first strap portion. For saddlery body straps, the second strap portion is in fact preferably in the form of an elongate tubular webbing sheath woven from yarn composed of staple fibres of synthetic polymer material and having an insert filling of cushioning material composed of at least one strip of foam expanded plastics material as described in my above-mentioned previous patent, while the first strap portion is preferably provided by one or more relatively high tensile strength continuous webbing bands or strips of woven nylon or like material secured directly at their ends to the end fastening fittings.

The relative lengths of the first and second strap portion loop sections of each loop region should in all cases be such that under load the slack of the bight of the first strap portion loop section is taken up before there is any risk of the corresponding second strap portion loop section stretching and extending beyond its elastic limit.

It will usually be preferred for a saddlery body strap in accordance with the invention to be provided with a single said loop region which will be located midway along its length, and the remainder of the band or strip, or each band or strip, making up the first strap portion outside the loop region will be secured along its length, as by stitching, to the second strap portion. The latter may advantageously extend beyond the ends of the first strap portion so that its end portions provide free end flaps adapted to overlie the buckles or other end fastening fittings and protect the body of the horse from contact with the latter during use.

Advantageously, the bight of the first strap portion loop section in the or each loop region may be partly confined in place by a transversely-extending layband loop secured to the second strap portion loop section.

BRIEF DESCRIPTION OF THE DRAWINGS

Other advantageous features will be apparent from the following description, presented by way of example only of a preferred embodiment, relating to a cinch which is constructed in accordance with the invention as illustrated in the accompanying drawings.

In said drawings.

DESCRIPTION OF PREFERRED EMBODIMENT

Figure 1:
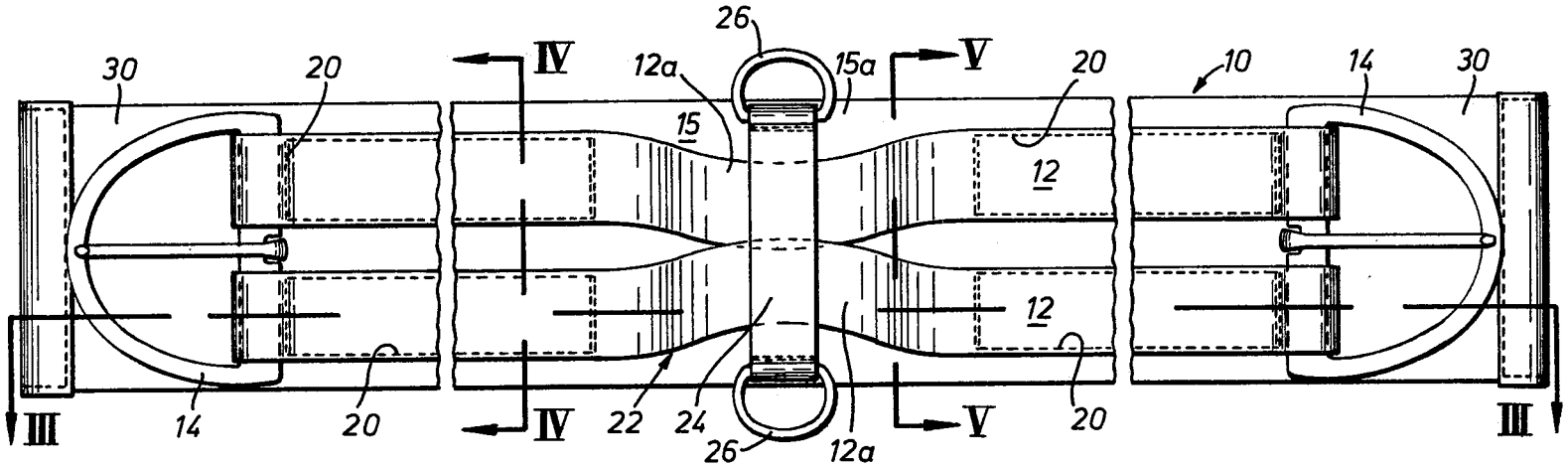
FIG. 1 is a partly broken away front elevational view of the cinch.
Figure 2:
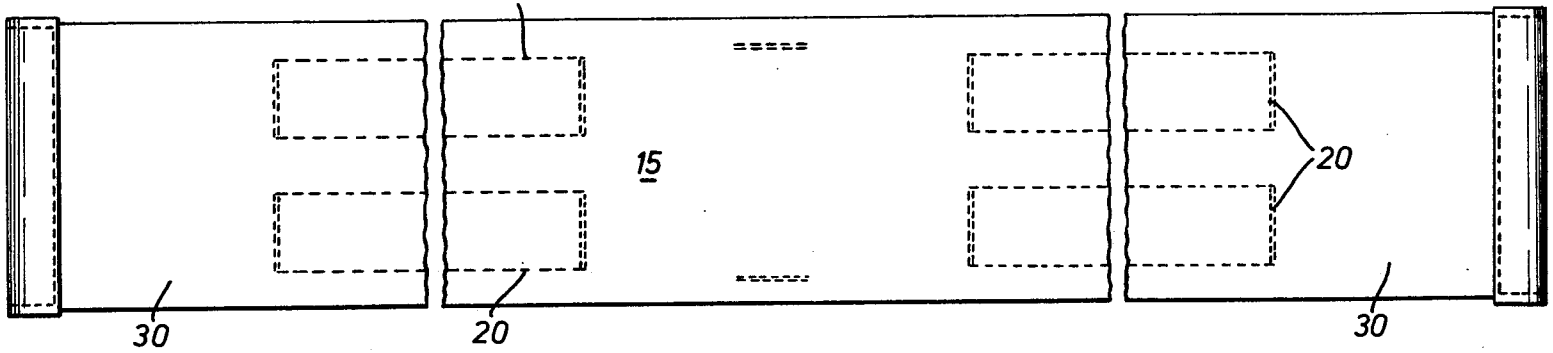
FIG. 2 is a similar rear elevational view thereof.
Figure 3:
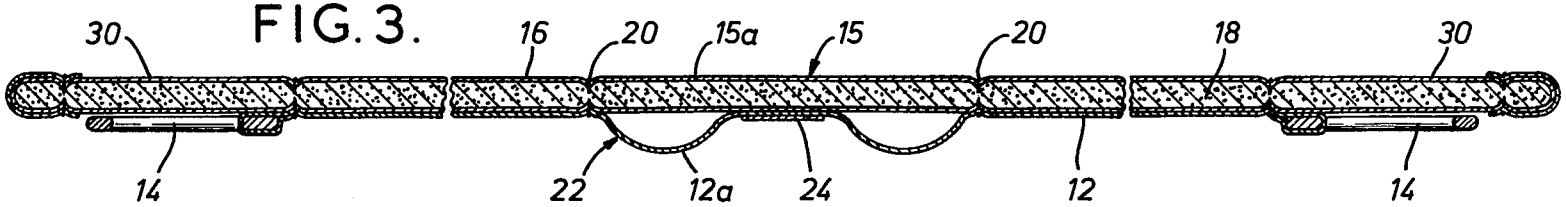
FIG. 3 is a longitudinal section on line III—III of FIG. 1 which has been inverted.
Figure 4:
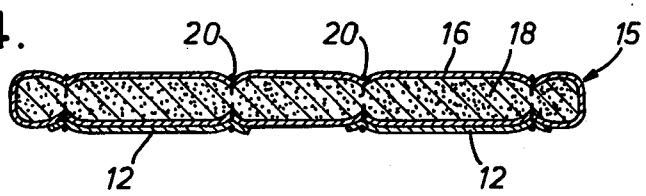
FIG. 4 is a transverse sectional view on line IV—IV of FIG. 1.
Figure 5:
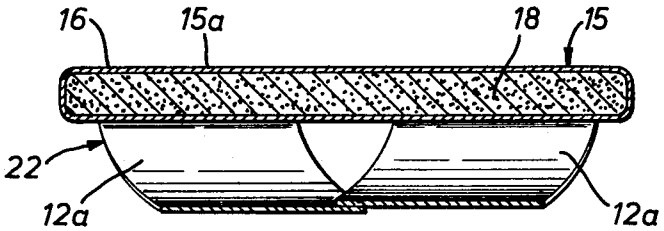
FIG. 5 is a transverse sectional view on line V—V of FIG. 1.

Referring to the drawings, the cinch illustrated therein is a body strap of a kind commonly used for securing a "Western type" saddle to a horse and, in use, it lies around the underside of the body of the horse and has its ends attached to straps depending at each side from the saddle.

In this embodiment, as shown, the cinch 10 comprises a pair of parallel continuous bands or strips 12, 12, which constitute a first strap portion connected at opposite ends directly to buckle end fittings 14. These bands or strips 12, 12, are tensile load-carrying members and are advantageously composed of nylon braid or webbing having a high breaking strength.

Overlying these bands or strips 12, 12, at the back, in face to face relationship therewith, is another relatively wide flat band or strip, constituting a second strap portion, which is in the form of a sheath member 15 of substantially rectangular cross-section made up of an elongate tubular webbing sheath envelope 16 containing, as an insert filling, a strip 18 of foam cross-linked expanded polyethylene or similar foam expanded plastics material providing relatively soft resiliently compressible cushioning characteristics. The sheath envelope 16 itself is advantageously formed of woven yarn composed of staple polyester fibre such as a "Terylene" fibre having a texture and appearance very similar to woven cotton fabric.

As shown, the sheath member 15 is secured to the bands or strips 12, 12, of the first strap portion by rectangular areas of machine stitching 20 which each extend continuously from the buckle end fittings 14 along the length of the cinch up to a central loop region 22 where the sheath member and bands or strips 12, 12, are not secured together. This loop region 22 may be regarded as being formed by a section **12*a*, termed a loop section, of each band or strip 12, which loop section has a preselected length, being secured at its opposite ends (by the machine stitched areas 20) to the opposite ends of a loop section 15*a* of the sheath member 15 which, in the unstressed condition, has a length less than that the loop section 12*a* such that the latter is folded into a bight spanned by the sheath member loop section 15*a*.**

The bight loop sections **12*a*, 12*a*, of the bands or strips 12, 12, pass through a transverse layband loop 24 of webbing which is secured to the sheath member 15 midway along the length of the cinch as shown, this layband loop 24 also providing an anchorage for metal rings 26, 26, which may be used for attaching a breast strap to the cinch. The layband loop 24 serves partly to confine the bight loop sections 12*a*, 12*a*** in place.

It is a feature of this construction that the sheath member 15 has a substantially greater elasticity than the nylon bands or strips 12, 12, of the first strap portion such that it stretches and resiliently extends further than the latter when subjected to tensile load, that is, it has a smaller modulus of elasticity. As a result, under light loads the cinch has a relatively high elasticity and will extend by stretching of the central loop section **15*a* of the sheath member which carries all the tensile load in this region. This enables the cinch to be designed so that under light loads it has sufficient "give" as not to restrict unduly movements of the horse's body and to ensure a comfortable fitting. Under increasing tensile load, however, a stage can be reached when the extension of the loop section 15*a* is such that all the slack of the bight loop sections 12*a*, 12*a*, is taken up and any further increase in load is shared, with the major part being borne by these loop sections 12*a*, 12*a*. This provides an abrupt increase in resistance to stretching and the cinch becomes relatively inextensible while the relatively high breaking strength of the bands or strips 12, 12, which then form the principal load carrying members extending continuously between the two end buckle fittings 14, 14,** gives a high degree of security under conditions in which the cinch is likely to be severely stressed.

This form of construction provides a particularly convenient means for controlling the overall elasticity characteristics, and apart from selecting the materials of appropriate physical characteristics, the extent of the loop region and relative lengths of the loop sections can be varied as required. Also, a plurality of similar loop regions may be provided spaced along the length of the strap, although a single loop region in the middle, as specifically described, may be preferred from the point of view of reducing the number of separate stitching operations necessary.

In the embodiment illustrated, it should also be noted that the sheath member 15 extends beyond the ends of the bands or strips 12, 12, so as to provide free end flaps 30, 30, which can overlie the buckles 14, 14, at the rear end serve to prevent the latter from contacting the body of the horse during use.

It will be appreciated that various modifications in the construction herein specifically described by way of example may be made, if desired, within the scope of the invention.

What is claimed is:

1. A strap, for example, a cinch strap, having:

(a) a first strap portion comprising at least one tensile band or strip;

(b) means for fastening said strap to a support, for example, a saddle, said means being at opposite ends of said strap;

(c) a second strap portion comprising a band or strip arranged in co-extensive longitudinal overlapping superimposed relationship with said first strap portion and attached thereto, said second strap portion being a support portion for the body of an animal such as a horse and being resiliently compressible in a direction at right angles to its length to provide cushioning characteristics for said strap against the body of an animal such as a horse;

(d) at least one closed loop region disposed intermediate the ends of said strap and comprising a length of said first strap portion, a length of said second strap portion, and means securing together said lengths at their opposite extremities to form said at least one loop region and so that said lengths are non-slidable relative to one another longitudinally of said strap;

(e) said length of said second strap portion being less than said length of said first strap portion when said strap is in a relaxed condition without longitudinal tensile load, the arrangement being effective in the relaxed condition to cause said length of said first strap portion to lie in a slack bight spanned by said second strap portion loop region whereby, in use of the strap under an increasing longitudinal tensile load, said load is transmitted through said length of said second strap portion which stretches and extends longitudinally until the slack of said bight of said first strap portion is taken up, any further increase in said tensil load then being shared between both of said lengths thereby providing an abrupt increase in resistance to stretching of said strap when said slack is taken up.

2. A strap as claimed in claim 1 in which said length of said second strap portion has a greater elasticity than said length of said first strap portion.

3. A strap as claimed in claim 2 in which said second strap portion is in the form of an elongate tubular webbing sheath of synthetic polymer material containing at least one strip of foam expanded plastics material, and said first strap portion is in the form of relatively high tensile strength webbing of woven nylon.

4. A strap as claimed in any one of the preceding claims having a central closed loop region and wherein:

(a) said first strap portion is attached to said second strap portion outside of said loop region or regions by means extending longitudinally therealong, for example, stitching;

(b) said first strap portion and said second strap portion are in face to face relationship;

(c) said means for fastening said strap to said support comprise buckles attached to said first strap portion; and (d) the ends of said second strap portion extend beyond the ends of the first strap portion to provide free end flaps which, in use of the strap as a cinch strap on a horse, overlie said buckles and protect the body of said horse from contact with said buckles.

5. A strap as claimed in claim 4 in which said bight is partly confined in place by a layband extending transversely of said strap and secured to said length of said second strap portion.

6. A strap as claimed in claim 5 in which said layband has means for fastening said strap to a breast strap.

7. A strap as claimed in claim 6 in which said at least one loop region provides, under initial longitudinal tensile load, a longitudinal region or regions of said strap having an elasticity at least equal to any other longitudinal region of said strap lying intermediate said means for fastening said strap to said support.

8. A saddle having at least one strap first composed of:

(a) a strap portion comprising at least one tensile band or strip;

(b) means for fastening said strap to the saddle, said means being at opposite ends of said strap;

(c) a second strap portion comprising a band or strip arranged in co-extensive longitudinal relationship with said first strap portion and attached thereto, said second strap portion being a support portion for the body of an animal such as a horse and being resiliently compressible in a direction at right angles to its length to provide cushioning characteristics for said strap against the body of an animal such as a horse;

wherein said strap has:

(i) at least one closed loop region disposed intermediate the ends of said strap and comprising a length of said first strap portion, a length of said second strap portion, and means securing together said lengths at their opposite extremities to form said at least one loop section; and (ii) said length of said second strap portion is less than said length of said first strap portion when said strap is in a relaxed condition without longitudinal tensile load, the arrangement being effective in the relaxed condition to cause said length of said first strap portion to lie in a slack bight spanned by said second strap portion loop region whereby, in use of the strap under an increasing longitudinal tensile load, said load is transmitted through said length of said second strap portion which stretches and extends longitudinally until the slack of said bight of said first strap portion is taken up, any further increase in said tensile load then being shared between both of said lengths thereby providing an abrupt increase in resistance to stretching of said strap when said slack is taken up.

* * * * *